US007517256B2

(12) United States Patent
Chang

(10) Patent No.: US 7,517,256 B2
(45) Date of Patent: Apr. 14, 2009

(54) ELECTRICAL CONNECTOR

(75) Inventor: Chun-Yi Chang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/901,370

(22) Filed: Sep. 17, 2007

(65) Prior Publication Data

US 2008/0070454 A1 Mar. 20, 2008

(30) Foreign Application Priority Data

Sep. 15, 2006 (CN) ..... 2006 2 0077326

(51) Int. Cl.
*H01R 13/502* (2006.01)

(52) U.S. Cl. ..... 439/701; 439/717

(58) Field of Classification Search ..... 439/701, 439/717, 65

See application file for complete search history.

(56) References Cited

U.S. PATENT DOCUMENTS 3,042,895 A * 7/1962 Bonhomme ..... 439/701
3,264,525 A * 8/1966 Swengel et al. ..... 361/733
4,527,285 A * 7/1985 Kekas et al. ..... 398/164
4,611,879 A * 9/1986 Bullard ..... 439/717
5,485,660 A * 1/1996 Pittau ..... 29/718
5,702,255 A * 12/1997 Murphy et al. ..... 439/71
6,155,872 A * 12/2000 Wu ..... 439/541.5
6,310,779 B1 * 10/2001 Wang ..... 361/760
6,510,724 B1 * 1/2003 Weiss et al. ..... 73/1.01
6,527,597 B1 * 3/2003 Harper, Jr. ..... 439/701
6,530,792 B2 * 3/2003 Lai et al. ..... 439/165
6,679,707 B1 * 1/2004 Brodsky et al. ..... 439/71
6,851,954 B2 * 2/2005 Ashman et al. ..... 439/70
6,860,741 B2 * 3/2005 Ashman et al. ..... 439/70
6,881,073 B2 * 4/2005 Bali et al. ..... 439/70
2005/0059302 A1 * 3/2005 Sablatzky ..... 439/701
2006/0105636 A1 * 5/2006 Crane et al. ..... 439/701
2007/0232132 A1 * 10/2007 Ling et al. ..... 439/541.5

* cited by examiner

*Primary Examiner*—T C Patel
*Assistant Examiner*—Vladimir Imas
(74) *Attorney, Agent, or Firm*—Wei Te Chung

(57) ABSTRACT

An electrical connector includes a frame including at least two supporting arms configuring at least one mounting area, at least one housing unit assembled to the supporting arms and located with the at least one mounting area. An inter-aligning arrangement is arranged between the supporting arms and the at least one housing so as to ensure the at least one housing unit is properly attached to the frame. The inter-aligning arrangement includes at least one groove located at one of the supporting arm and the housing unit, and at least one projection located at the other.

1 Claim, 3 Drawing Sheets

ELECTRICAL CONNECTOR

BACKGROUND OF THE INVENTION

1. Field of the Invention

The present invention relates to the art of electrical connectors, and more particularly to a connector having more contacts thereof.

2. Background of the Invention

Generally speaking, a connector to which this invention is applicable is interposed between first and second electronic parts or components having contact pads, respectively, to achieve electrical connection between the first and the second electronic components. In the following description, the first and the second electronic components are a printed board and an LSI circuit, respectively. The connector comprises an insulator provided with a plurality of contact receptacle holes penetrating the insulator in a thickness direction, and a plurality of contacts having an elasticity and inserted into and held in the contact receptacle holes, respectively.

However, in the conventional electrical connectors, housings are usually molded by an injected art, so when housing needs receive more terminal therein for getting a better electrical connection and transmitting more signals, numbers of passageways formed on the housing need be increased correspondingly which leads the housing difficulty to mold or insulative material not fully of moulds In view of the foregoing, there exists a need for an electrical connector for simplifying the process of the production and avoiding problem of the insulative material which is not full injected.

SUMMARY OF THE INVENTION

Accordingly, an object of the present invention is to provide an electrical connector for increasing the number of the contacts thereof.

To achieve the above-mentioned object, in a preferred embodiment of the present invention, an electrical connector is provided and comprises a frame including at least two supporting arms configuring at least one mounting area, at least one housing unit assembled to the supporting arms and located with the at least one mounting area. An inter-aligning arrangement is arranged between the supporting arms and the at least one housing so as to ensure the at least one housing unit is properly attached to the frame. The inter-aligning arrangement includes at least one groove located at one of the supporting arm and the housing unit, and at least one projection located at the other. The electrical connector includes a plurality of housings each having a plurality of contacts, so the number of contacts of the electrical connector is increased.

DETAILED DESCRIPTION OF THE PREFERRED EMBODIMENT OF THE INVENTION

A preferred embodiment of the present invention will be described hereunder with reference to the accompanying drawings FIG. 1-FIG. 2.

Figure 1:
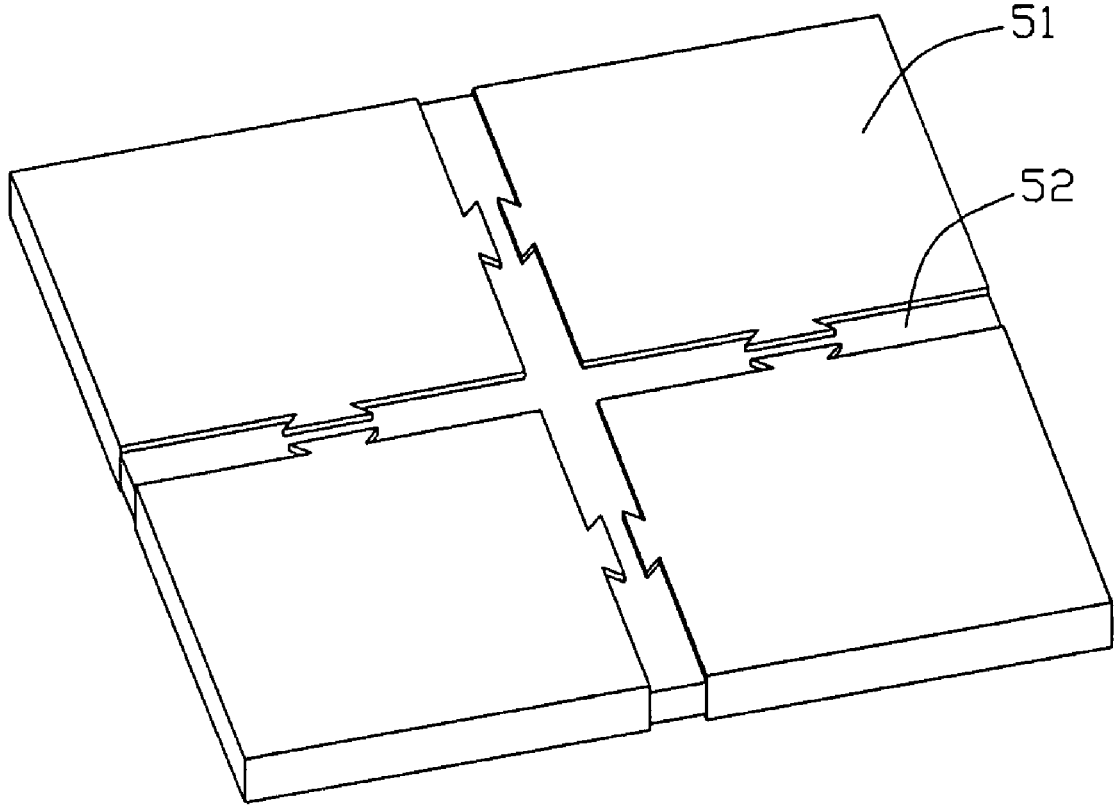
FIG. 1 is an assembly view of an electrical connector in accordance with a preferred embodiment of the present invention.
Figure 2:
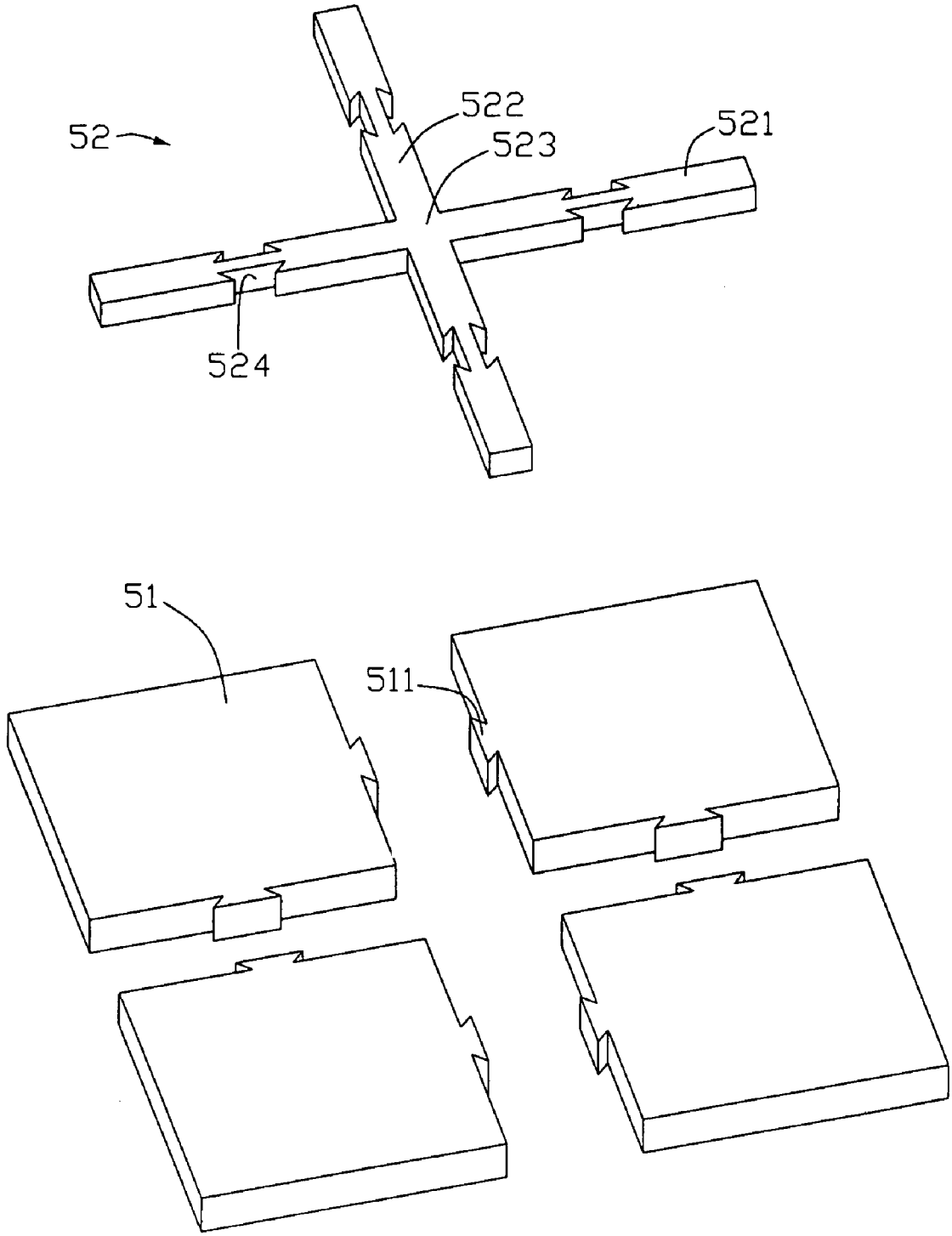
FIG. 2 is an exploded isometric view of the electrical connector shown in FIG. 1.

Referring to FIGS. 1-2, an electrical connector 5 of the present invention is used for establishing an electrical connection between an IC package and a PCB and includes four housing units 51, a middle frame 52, wherein each of the housing units 51 defines a plurality of passageways (not shown) for receiving corresponding electrical contacts (not shown).

Referring to FIG. 1, each housing unit 51 is formed from molding in a square shape. Two adjacent sides of the housing unit 51 are define a projecting portion 511, respectively, which is used for engaging with the groove 524 by interference fit to secure a housing unit 51 on the middle frame 52.

The middle frame 52 includes an one set (or type) supporting arm 521 and the second set supporting arm 522, and the two supporting arm are arranged in a crisscross. Said arms intersected at a combining site 523, and each arm defines a plurality of grooves 524 on each end thereof apart from the combining sites 523, and each end of said arms defines at least two grooves 524 arranged in a symmetrical manner.

In an assembling process, firstly, each housing unit 51 is placed above the middle frame 52 and the projecting portions 511 of each housing unit 51 are aligning to one groove 524 of the first set supporting arm 521 and one groove 524 on the second supporting arm 522; then, to press the housing unit 521 so as to ensure the projecting portions 511 engaged with the grooves 524. Accordingly, the housing units and the middle frame 52 are assembled together.

Figure 3:
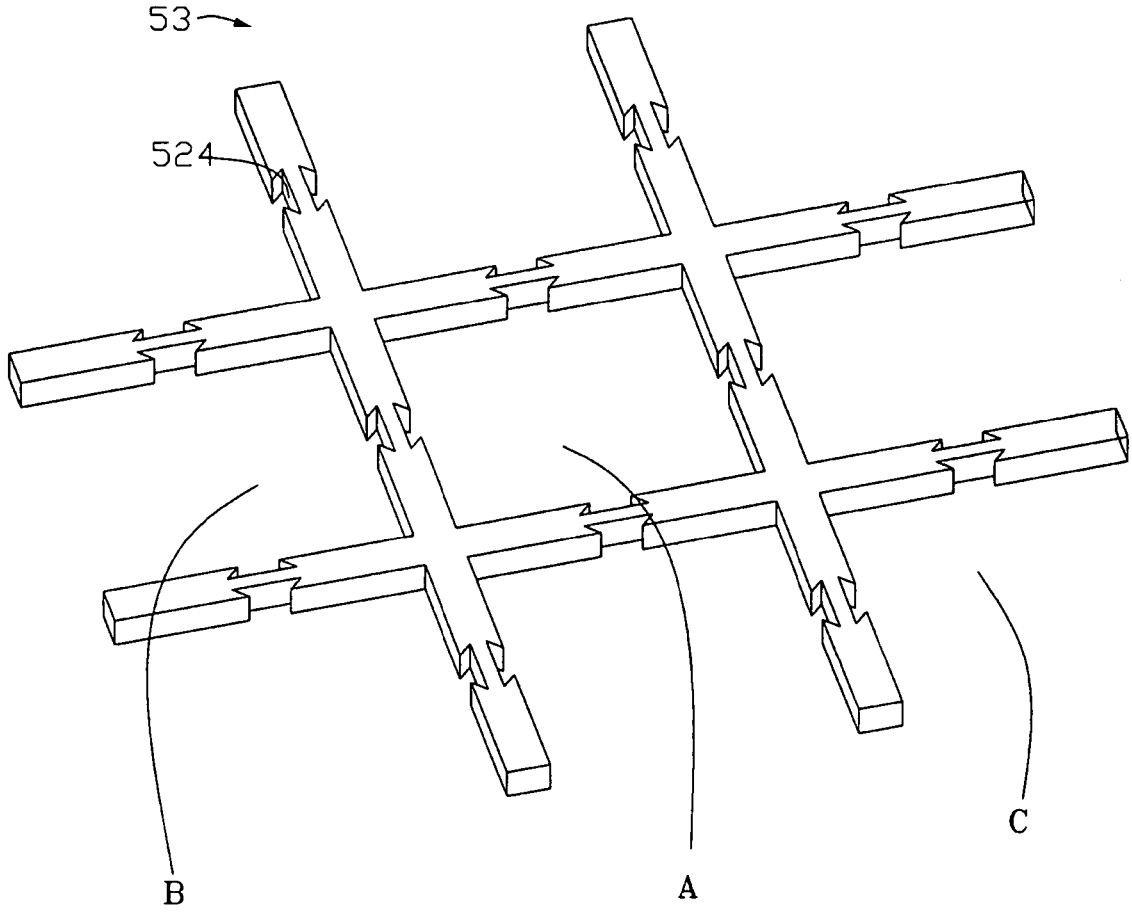
FIG. 3 is a perspective view of a frame in accordance with another preferred embodiment of the present invention.

FIG. 3 illustrates another preferred embodiment of the present invention. This electrical connector 5 also comprises a plurality of housing units (not shown), and a frame 53. The housing unit is similar to the said housing units 511 in above-mentioned embodiment of the present invention, but the frame 53 of this preferred embodiment has some differences from said middle frame 52. In this embodiment of the invention, the frame 53 includes a plurality of the one and second supporting arms arranged in a crossed pattern; accordingly, the frame 53 is divided into several different sections that may be called section A, B, and C. These sections A are closed quadrilateral, and those sections B are have three sides, and each sections C only have two sides. Every section A defines at least one groove 524 on at least one side, and the section B and C is similar to the section A. In this embodiment accordance with the present invention, assembly method is same with the manner in above-mentioned embodiment of the present invention.

Additionally, what is needed to point out, in above-mentioned embodiment of the present invention, each housing unit 511 is in a square shape and the supporting arms of the frame 52, 53 are arranged in a vertical crossed manner, obviously, but the housing unit 511 may be other shapes and said supporting arms could arranged in other manner as soon as the housing unit 511 can be mounted on the frame 52,53. For instance, the frame 52, 53 may includes a plurality of supporting arms and there are any connection relations between random two supporting arms. In assembly, said supporting arms are parallel to each other, and by means of the projecting portions engaged with said grooves, the electrical connector 5 is assembled completely. Furthermore, in above-mentioned embodiment of the present invention, the housing unit 51 defines a plurality of projecting portions 511 and the frame 52, 53 defines a number of groove 524; obviously, they are interchangeable.

Furthermore, although the present invention has been described with the preferred embodiment referring to FIGS. 1-3, it is not to be construed as being limited thereto and has other alterations.

What is claimed is:

1. An electrical connector assembly comprising:

a frame comprising plurality of spaced supporting arms extending along longitudinal and transverse directions perpendicular to each other with at least one intersection thereof;

a plurality of insulative housing units adapted to be attached to said corresponding arms and;

an interlocking mechanism is applied to said supporting arms and said housing units; wherein said frame is essentially of a cross-like configuration so as to expose the housing units laterally in both longitudinal direction and transverse direction along a periphery of a combination of said frame and housing units so that said frame forms a plurality of retention units along said periphery and each of said retention units defines a four sided structure with either one open side or two adjacent open sides for holding the corresponding connector unit.

* * * * *